US012145022B2

(12) United States Patent
Yoo

(10) Patent No.: US 12,145,022 B2
(45) Date of Patent: Nov. 19, 2024

(54) TREADMILL AND PULLEY USED THEREIN

(71) Applicant: DRAX INC., Anyang-si (KR)

(72) Inventor: Seon Kyung Yoo, Seoul (KR)

(73) Assignee: Drax Inc., Anyang-si (KR)

( * ) Notice: Subject to any disclaimer, the term of this patent is extended or adjusted under 35 U.S.C. 154(b) by 242 days.

(21) Appl. No.: 17/735,970

(22) Filed: May 3, 2022

(65) Prior Publication Data

US 2022/0362626 A1 Nov. 17, 2022

(30) Foreign Application Priority Data

May 11, 2021 (KR) ..... 10-2021-0060603
Apr. 8, 2022 (KR) ..... 10-2022-0044121

(51) Int. Cl.
*A63B 22/02* (2006.01)
*A63B 71/00* (2006.01)

(52) U.S. Cl.
CPC ..... *A63B 22/0207* (2015.10); *A63B 22/02* (2013.01); *A63B 22/0285* (2013.01); *A63B 2071/009* (2013.01)

(58) Field of Classification Search
CPC . A63B 22/02; A63B 22/0207; A63B 22/0214; A63B 22/0221; A63B 22/0228; A63B 22/0285; A63B 2071/009; A63B 71/0054; A62B 22/20; F16H 7/02;
(Continued)

(56) References Cited

U.S. PATENT DOCUMENTS 5,470,293 A 11/1995 Schonenberger
5,562,572 A 10/1996 Carmein
(Continued)

FOREIGN PATENT DOCUMENTS

CN 1091328 A 8/1994
CN 102133464 A 7/2011
(Continued)

OTHER PUBLICATIONS

Office Action dated Oct. 21, 2023 in Chinese Application No. 202210510651.X.
(Continued)

*Primary Examiner* — Megan Anderson
*Assistant Examiner* — Jonathan A Dicuia
(74) *Attorney, Agent, or Firm* — Knobbe, Martens, Olson & Bear, LLP

(57) ABSTRACT

This application relates to a treadmill. In one aspect, the treadmill includes a frame structure, a track part configured to rotate with respect to the frame structure, and a rotation unit disposed in the frame structure and rotatably supporting the track part. The track part may include a plurality of slats arranged in a rotation direction and a track belt disposed at both end portions of the plurality of slats and connecting the plurality of slats. The rotation unit may include first rotation members disposed in front and rear of the frame structure. At least one of the first rotation members includes a plurality of grooves arranged apart from each other on an outer circumferential surface of the at least one of the first rotation members in a circumferential direction, to have a surface shape different from an inner circumferential surface of the track belt.

11 Claims, 17 Drawing Sheets

(58) Field of Classification Search
CPC . F16H 55/49; F16H 55/36; F16H 7/18; B65G 26/06; B65G 23/06
USPC ..... 482/54; 198/834, 835
See application file for complete search history.

(56) References Cited

U.S. PATENT DOCUMENTS

| | | | | |
|---|---|---|---|---|
| 8,343,016 | B1 * | 1/2013 | Astilean | A63B 23/0405 482/54 |
| 8,464,862 | B2 * | 6/2013 | Honeycutt | B65G 15/42 198/822 |
| 11,364,411 | B2 | 6/2022 | Yoo et al. | |
| 2005/0082147 | A1 * | 4/2005 | Mol | B29C 48/001 198/834 |
| 2006/0019783 | A1 | 1/2006 | Hoag | |
| 2010/0170769 | A1 * | 7/2010 | Jung | A63B 22/02 198/570 |
| 2012/0010053 | A1 * | 1/2012 | Bayerlein | A63B 22/0017 482/54 |
| 2016/0166877 | A1 * | 6/2016 | Cei | A63B 22/0285 482/54 |
| 2016/0341290 | A1 * | 11/2016 | Lin | F16H 7/18 |
| 2017/0312567 | A1 | 11/2017 | Chang | |
| 2018/0264315 | A1 * | 9/2018 | Chen | A63B 22/0221 |
| 2019/0083844 | A1 * | 3/2019 | Bayerlein | A63B 69/0057 |
| 2019/0143169 | A1 | 5/2019 | Astilean et al. | |
| 2020/0009418 | A1 * | 1/2020 | Lo | A63B 22/0235 |
| 2020/0254302 | A1 | 8/2020 | Yoo et al. | |

FOREIGN PATENT DOCUMENTS

| | | | |
|---|---|---|---|
| CN | 111544829 | A | 8/2020 |
| CN | 112675481 | A | 4/2021 |
| EP | 2221507 | A2 | 8/2010 |
| KR | 2020-0098397 | A | 8/2020 |

OTHER PUBLICATIONS

Extended European Search Report in EP Application No. 22172127.7 dated Oct. 10, 2022.
Office Action received in Korean Application No. 10-2022-0044121 dated Feb. 10, 2024.

* cited by examiner

TREADMILL AND PULLEY USED THEREIN

CROSS-REFERENCE TO RELATED APPLICATIONS

This application claims the benefits of Korean Patent Application No. 10-2021-0060603, filed on May 11, 2021, in the Korean Intellectual Property Office, and Korean Patent Application No. 10-2022-0044121, filed on Apr. 8, 2022, in the Korean Intellectual Property Office, the disclosures of which are incorporated herein in their entirety by reference.

BACKGROUND

Technical Field

The disclosure relates to a treadmill and a pulley used in the treadmill.

Description of Related Technology

A treadmill, called a running machine, is an exercise device having an effect of walking or running in a narrow space using a belt rotating in an endless orbit. The treadmill can be used, regardless of the weather, for walking or running exercise indoors at an appropriate temperature, and thus, a demand for treadmill is increasing day by day.

The treadmill may be divided into a powered treadmill in which a track part is rotated by a separate driving device, and a non-powered treadmill in which the track part is rotated by a user's operation without the separate driving device.

The non-powered treadmill is inexpensive compared to the powered treadmill because the separate driving device is unnecessary, and thus, the size and weight of the treadmill are also reduced much. Recently, a demand for the non-powered treadmills is gradually increasing.

SUMMARY

Provided are a treadmill in which a collision between a track belt and a pulley may be reduced by improving the shape of an outer circumferential surface of a pulley, and a pulley used in the treadmill.

Additional aspects will be set forth in part in the description which follows and, in part, will be apparent from the description, or may be learned by practice of the presented embodiments.

According to an aspect of the disclosure, a treadmill includes a frame structure, a track part capable of rotating with respect to the frame structure, and a rotation unit disposed in the frame structure and rotatably supporting the track part, wherein the track part includes a plurality of slats arranged in a rotation direction, and a track belt disposed at both end portions of the plurality of slats and connecting the plurality of slats, the rotation unit includes first rotation members disposed in front and rear of the frame structure, and a plurality of second rotation members disposed between the first rotation members, having a diameter less than a diameter of each of the first rotation members, and arranged according to an upper shape of the frame structure, and at least one of the first rotation members includes a plurality of grooves arranged apart from each other on an outer circumferential surface of the at least one of the first rotation members in a circumferential direction, to have a surface shape different from an inner circumferential surface of the track belt.

The outer circumferential surface of the at least one of the first rotation members may include a plurality of non-contact areas in which the plurality of grooves are formed and a plurality of contact areas disposed between the plurality of grooves and contacting the track belt.

The width of each of the plurality of non-contact areas in a circumferential direction may be less than the width of each of the plurality of contact areas in a circumferential direction.

The plurality of grooves may be arranged in a circumferential direction at regular intervals.

An inner circumferential surface of the track belt may have a shape different from the outer circumferential surface of the at least one of the first rotation members.

The inner circumferential surface of the track belt may have an unpatterned shape.

The track part may be configured to be rotated, without power, by a user.

An upper shape of the frame structure may have a concave shape in a middle portion thereof.

According to another aspect of the disclosure, a pulley of a treadmill, the pulley rotatably supporting a track belt of a track part in the treadmill, the pulley includes a plurality of grooves arranged apart from each other on an outer circumferential surface of the at least one of the first rotation members in a circumferential direction, to have a surface shape different from an inner circumferential surface of the track belt.

The outer circumferential surface may include a plurality of non-contact areas in which the plurality of grooves are formed and a plurality of contact areas disposed between the plurality of grooves and contacting the track belt.

The width of each of the plurality of non-contact areas in a circumferential direction may be less than the width of each of the plurality of contact areas in a circumferential direction.

The plurality of grooves may be arranged in a circumferential direction at regular intervals.

The outer circumferential surface may have a shape different from a shape of the inner circumferential surface of the track belt.

Other aspects, features, and advantages than those described above will become apparent from the following drawings, claims, and detailed description of the disclosure These general and specific embodiments may be implemented by using a system, a method, a computer program, or a combination thereof.

BRIEF DESCRIPTION OF THE DRAWINGS

These and/or other aspects will become apparent and more readily appreciated from the following description of the embodiments, taken in conjunction with the accompanying drawings.

DETAILED DESCRIPTION

Figure 1:
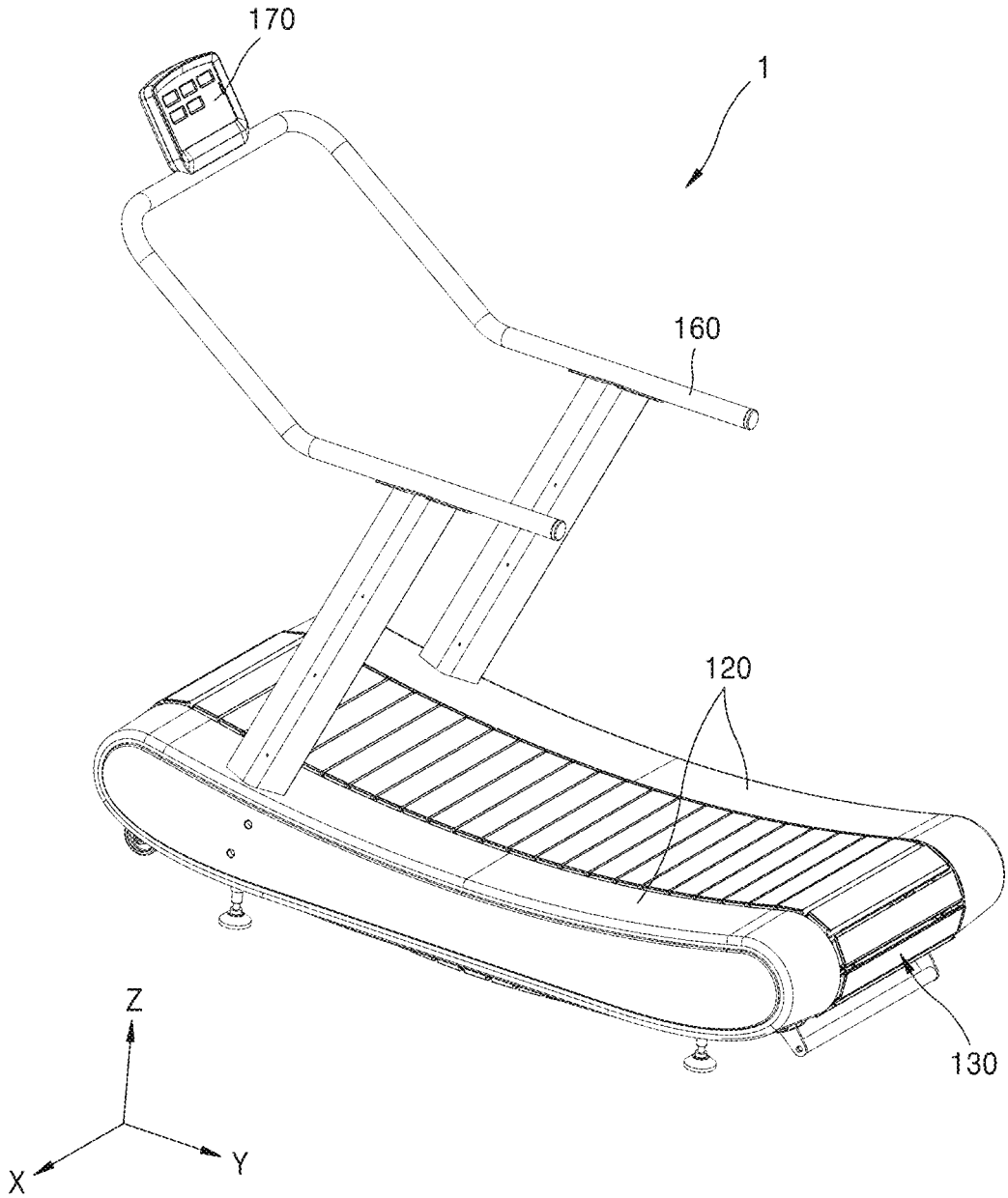
FIG. 1 is a perspective view of a treadmill according to an embodiment.

In the non-powered treadmill, since the track part is rotated by the user, the track part may sway due to the impact by a user. Due to the sway of the track part, a collision may occur between the track part and a component supporting the track part, which may appear as noise causing inconvenience to the user.

Reference will now be made in detail to embodiments, examples of which are illustrated in the accompanying drawings, wherein like reference numerals refer to like elements throughout. In this regard, the present embodiments may have different forms and should not be construed as being limited to the descriptions set forth herein. Accordingly, the embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

Hereinafter, an embodiment of the disclosure is described in detail with reference to the accompanying drawings. In the drawings, like reference numeral denote like constituent element, and the size or thickness of each constituent element may be exaggerated for clarity of explanation.

Figure 2:
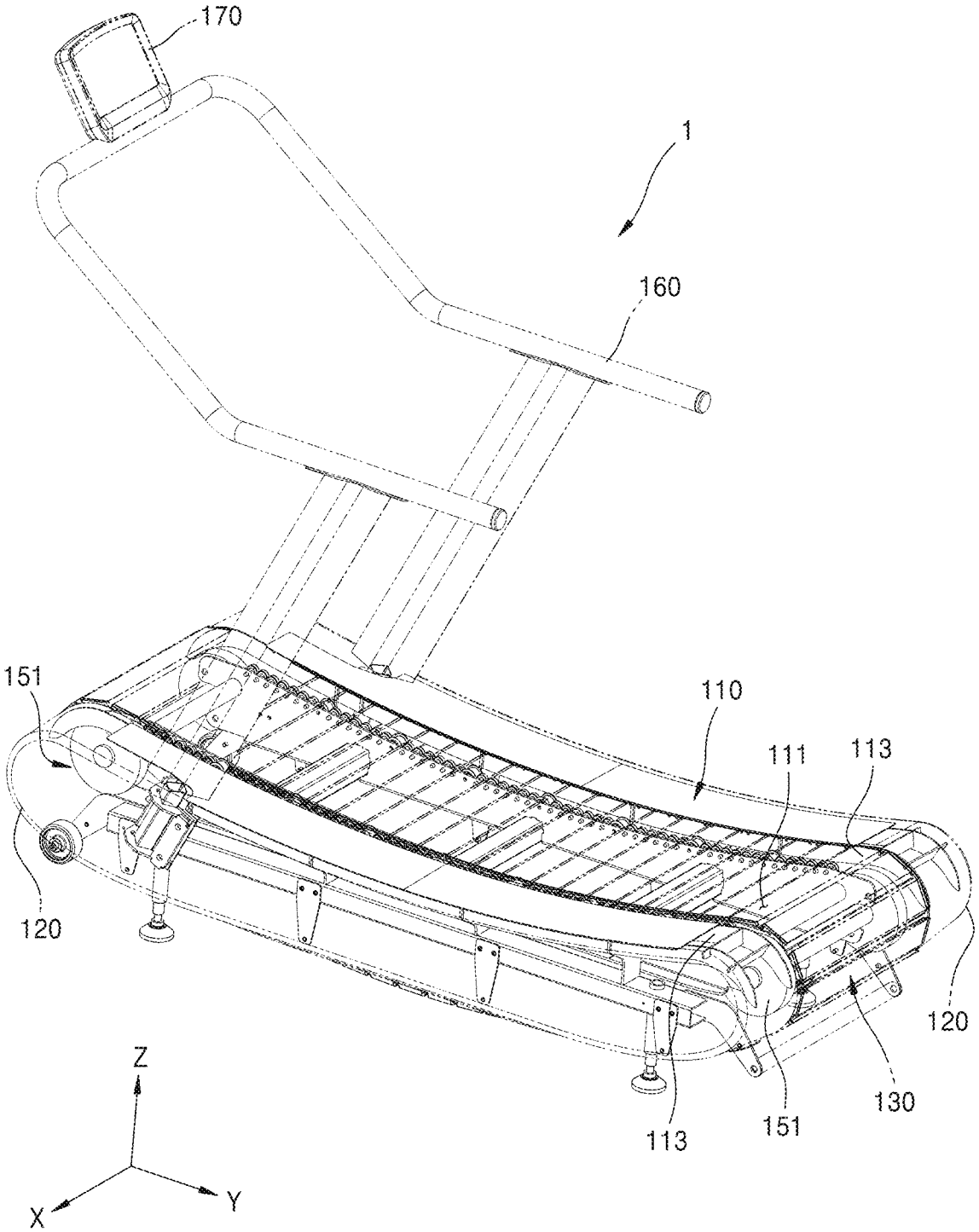
FIG. 2 is a perspective view mainly showing an internal structure of the treadmill of FIG. 1.
Figure 3:
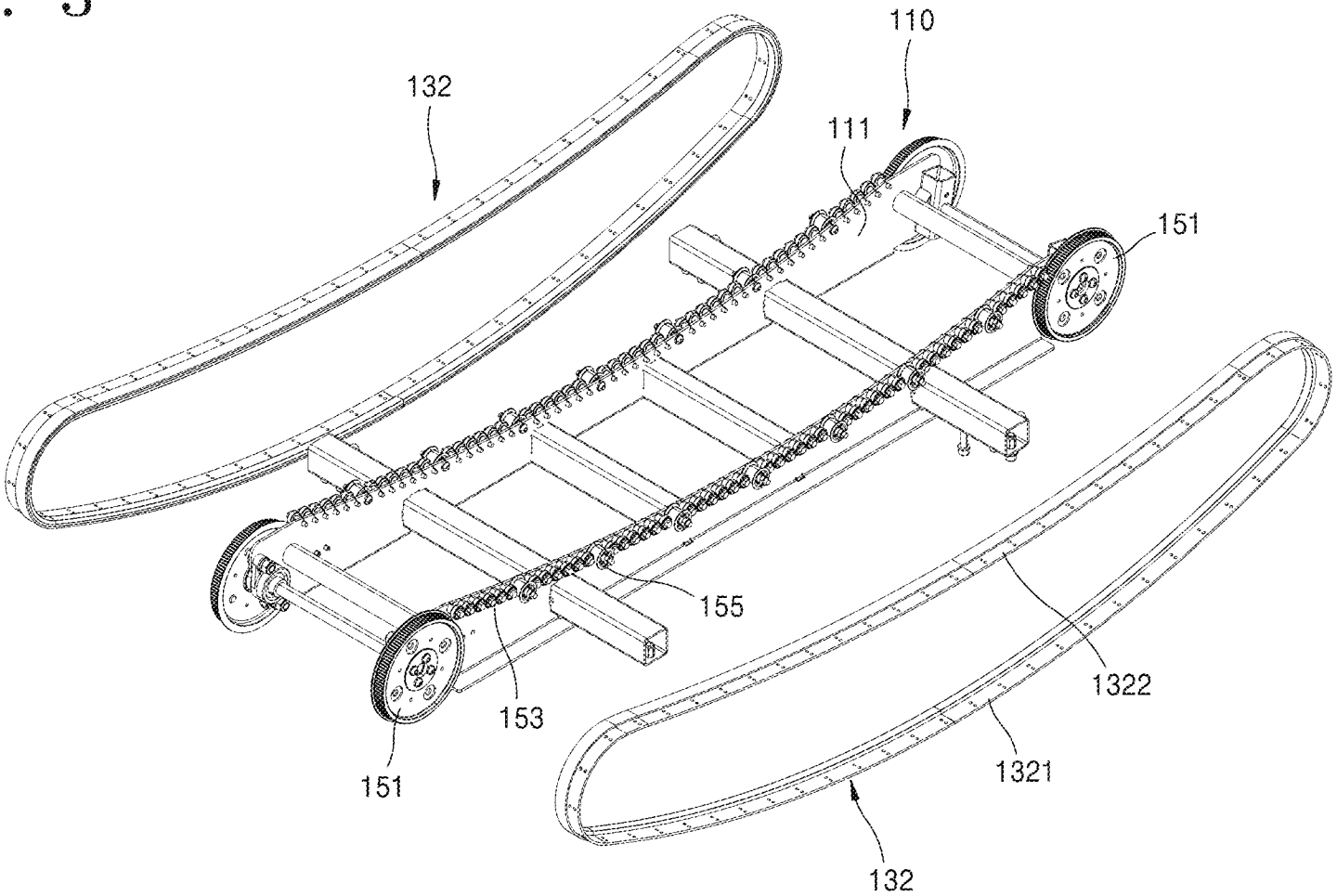
FIG. 3 is a perspective view showing the internal structure of the treadmill.

FIG. 1 is a perspective view of a treadmill 1 according to an embodiment. FIG. 2 is a perspective view mainly showing an internal structure of the treadmill 1 of FIG. 1. FIG. 3 is a perspective view showing the internal structure of the treadmill 1. In FIG. 3, for convenience of explanation, a track belt 132 of a track part 130 and a rotation unit 150 are mainly illustrated, while the illustration of a side frame 113 and a plurality of slats 131 is omitted.

Referring to FIGS. 1 to 3, the treadmill 1 according to an embodiment includes a frame structure 110, the track part 130 capable of rotating with respect to the frame structure 110, and the rotation unit 150 rotatably supporting the track part 130. The treadmill 1 may further include a handle part 160 to be held by a user U and an output unit 170 for showing an exercise result. The treadmill 1 may be a non-powered treadmill in which the track part 130 is rotated, without power, by a foot operation (such as walking or running) of the user U.

The frame structure 110 maintains the shape of the treadmill 1, and includes a center frame 111 and the side frame 113 disposed at each of both side portions of the center frame 111. The side frame 113 may be covered by a side cover 120.

The track part 130 may include the slats 131 and the track belt 132 connecting the slats 131.

The slats 131 are arranged in a first direction (Y direction) that is a rotation direction of the track part 130. Each of the slats 131 extends in a second direction (X direction) that is perpendicular to the rotation direction of the track part 130.

The track belt 132 extends in the first direction (Y direction), and is disposed at both end portions of the slats 131. The track belt 132 is provided in a pair at both end portions of each of the slats 131 and connects the slats 131.

The track belt 132 may be formed of a flexible material and wound around first rotation members 151. The track belt 132 may include an elastic material, for example, rubber.

The track part 130 may have a certain weight. For example, the weight of the track part 130 including the slats 131 and the track belt 132 may be 5 kg to 100 kg.

The rotation unit 150 for rotatably supporting the track part 130 is disposed in the frame structure 110. The rotation unit 150 may include the first rotation member 151 disposed in the front and the rear of the frame structure 110, and a plurality of second rotation members 153 disposed between the first rotation member 151 disposed in the front side and the first rotation member 151 disposed in the rear side. The rotation unit 150 may further include guide rollers 155 for preventing shaking of the track part 130.

The first rotation member 151 may be disposed in each of the front and the rear of the frame structure 110. For example, while one pair of first rotation members 151 may be provided in the front of the center frame 111, another pair of first rotation members 151 may be provided in the rear of the center frame 111. The first rotation member 151 may be a pulley.

The second rotation members 153 may be disposed between the first rotation members 151 disposed in the front and rear sides. For example, the second rotation members 153 may be provided on the center frame 111 between the first rotation members 151 disposed in the front and rear sides. The second rotation members 153 may be arranged according to an upper shape of the frame structure 110.

The upper shape of the center frame 111 may be concave in a middle portion thereof. In this case, the second rotation members 153 may be arranged in a curved form according to the upper shape of the center frame 111. The middle portion of the curved form may have a concave shape. The second rotation members 153 may be bearing members. The angle of a surface of the track part 130 that the user U contacts may vary according to the arrangement shape of the second rotation members 153.

The guide roller 155 may include a pair of protrusions for restricting a movement of the track belt 132 in the second direction, even when a force is applied to the track belt 132 in the second direction (X direction). Accordingly, the guide roller 155 may prevent the track belt 132 from being uncontacted and released from the second rotation members 153.

The track belt 132 may be disposed at both end portions of each of the slats 131, and rotated while being wound around the first rotation member 151 of the rotation unit 150. The slats 131 connected by the track belt 132 are rotated by the rotation of the track belt 132.

Figure 4:
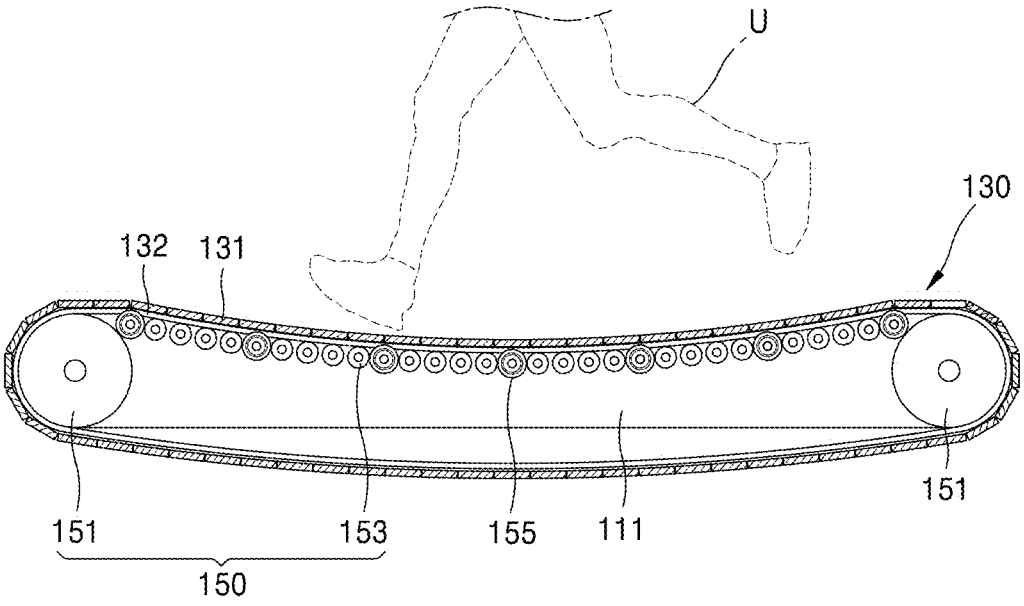
FIG. 4 is a view showing the rotation of a track part of the treadmill.
Figure 5:
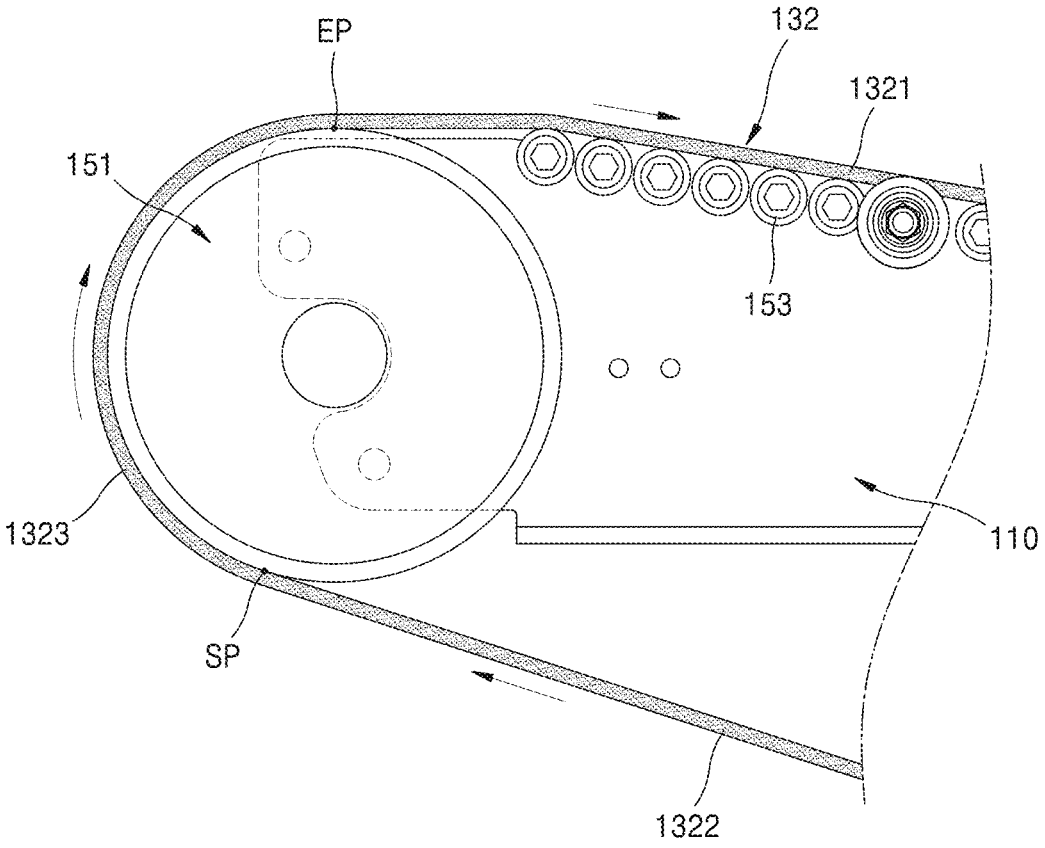
FIG. 5 is a view for explaining a first rotation member when the track part rotates.
Figure 6A:
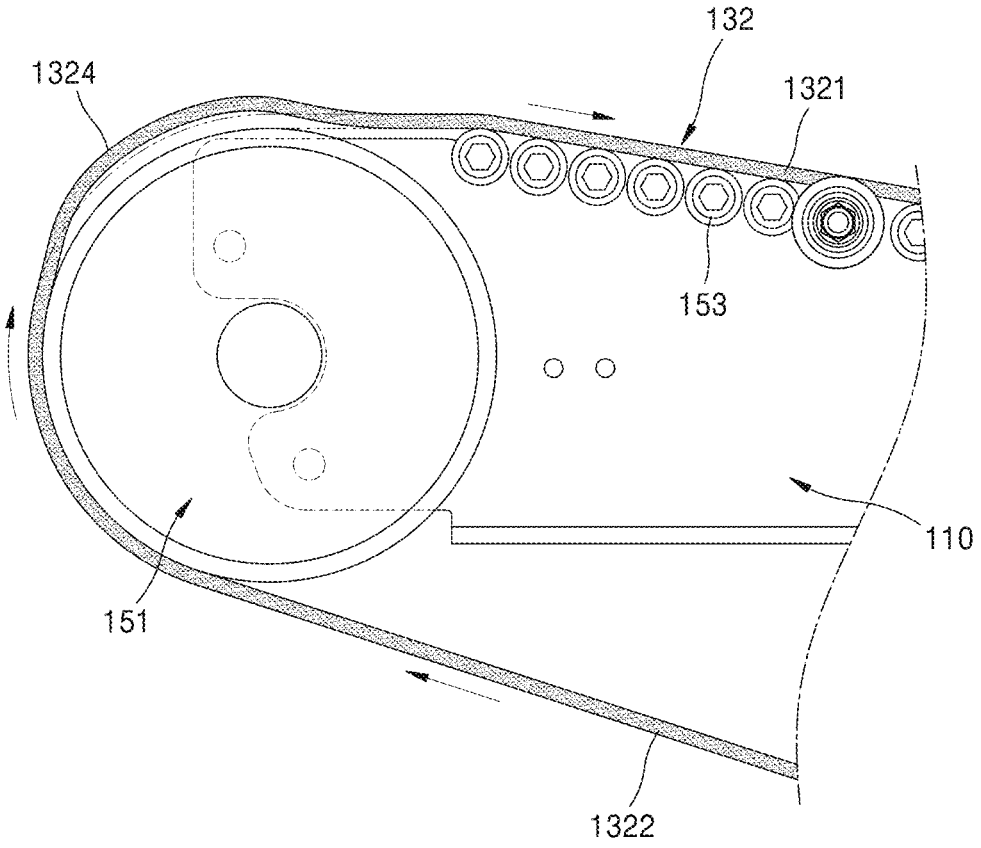
FIGS. 6A and 6B are views for explaining a phenomenon occurring between a track belt and the first rotation member during the rotation of the track part of the treadmill.
Figure 6B:
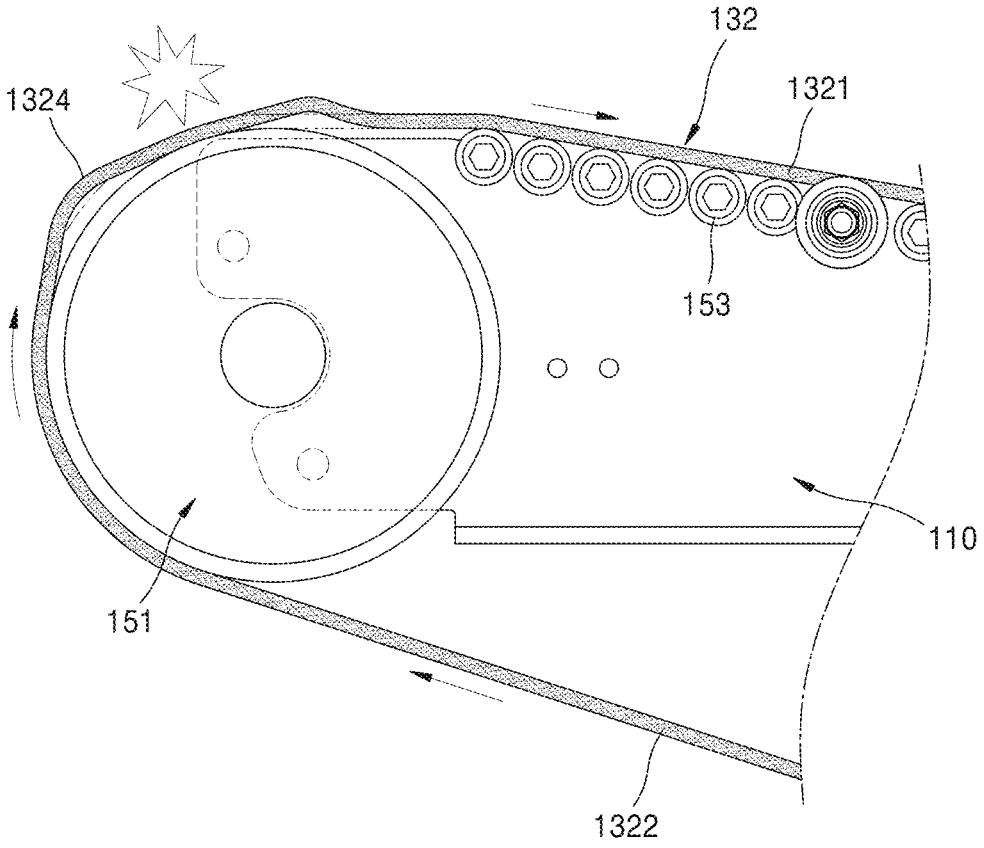

FIG. 4 is a view showing the rotation of the track part 130 of the treadmill 1. FIG. 5 is a view for explaining the first rotation member 151 when the track part 130 rotates. FIGS. 6A and 6B are views for explaining a phenomenon occurring between the track belt 132 and the first rotation member 151 during the rotation of the track part 130 of the treadmill 1.

Referring to FIGS. 4 and 5, when the user U performs the foot operation on the track part 130, a force of moving backward acts on the track part 130. The track part 130, which is rotatably supported by the first rotation members 151 disposed in the front and rear sides and the second rotation members 153 disposed between the first rotation members 151, is rotated by the foot operation of the user U, as described above.

In the treadmill 1, when the user U runs fast, the track part 130 is rotated fast, and when the user U runs slowly, the track part 130 is rotated slowly. When the user U stops, the track part 130 is stopped.

As described above, as the user U exercises on the track part 130 that is rotated according to the running speed of the user U, the speed may be smoothly adjusted without a separate additional manipulation, and thus, the user U may more actively exercise.

Referring to FIG. 5, in a process in which the track belt 132 rotates, a lower area 1322 disposed in a lower portion of the track belt 132 moves toward the front side, and an upper area 1321 disposed in an upper portion of the track belt 132 moves to the rear side. The first rotation member 151 changes the movement direction of the track belt 132 in a process in which the lower area 1322 is turned to the upper area 1321.

In an ideal environment, in a process in which the movement direction of the track belt 132 is changed by the first rotation member 151, a contact between the first rotation member 151 and the track belt 132 begins from a certain position, for example, a point SP, the track belt 132 maintains the contact with the first rotation member 151 in a certain region 1323, and the contact between the first rotation member 151 and the track belt 132 is removed at a certain position, for example, a point EP. Thus, without generating irregular noise between the track belt 132 and the first rotation member 151, the track part 130 may be smoothly rotated.

However, under the actual environment of the treadmill 1, irregular slip may be generated between the track belt 132 and the first rotation member 151 due to various factors such as user's foot operation and the like.

Referring to FIG. 6A, a phenomenon that the track belt 132 and the first rotation member 151 are separated from each other without contacting each other may occur in a partial area 1324 of the track belt 132 in which the track belt 132 necessarily keeps in contact with the first rotation member 151.

It is estimated that the phenomenon occurs due to various factors such as a state of the track belt 132, a speed difference of the first rotation member 151 and the track belt 132, and the like.

As an example, a material having a certain strength to connect and support the slats 131 may be used for the track belt 132 used in the treadmill 1. The track belt 132 including such a material may exhibit a slightly stiff characteristic. Furthermore, in a process of manufacturing or forming the track belt 132 the track belt 132 may have partially different bending characteristics. As such, in a process in which the track belt 132 having an entirely or partially stiff characteristic is rotated while wound around the first rotation member 151, slip may occur between the first rotation member 151 and the track belt 132, a phenomenon may occur in which the track belt 132 and the first rotation member 151 are momentarily separated from each other at a position where the contact between the track belt 132 and the first rotation member 151 is necessarily maintained.

In another example, the track belt 132 is a structure that rotates by surrounding the first rotation member 151, and thus, a rotation radius of the track belt 132 is greater than a rotation radius of the first rotation member 151. As such, as rotation radii of the first rotation member 151 and the track belt 132 are different from each other, even when rotational angular speeds of the first rotation member 151 and the track belt 132 are the same, linear speeds of the first rotation member 151 and the track belt 132 differ from each other. Accordingly, slip may occur between the track belt 132 and the first rotation member 151.

As such, a phenomenon that the partial area 1324 of the track belt 132 is temporarily separated from the first rotation member 151 occurs for various reasons, and thus, as illustrated in FIG. 6B, the partial area 1324 of the track belt 132 that is temporarily separated may collide against the first rotation member 151. Such a collision may occur irregularly and may generate noise that gives the user U discomfort.

Considering the above matter, the treadmill 1 according to an embodiment may provide the first rotation member 151 having an improved surface structure.

Figure 7:
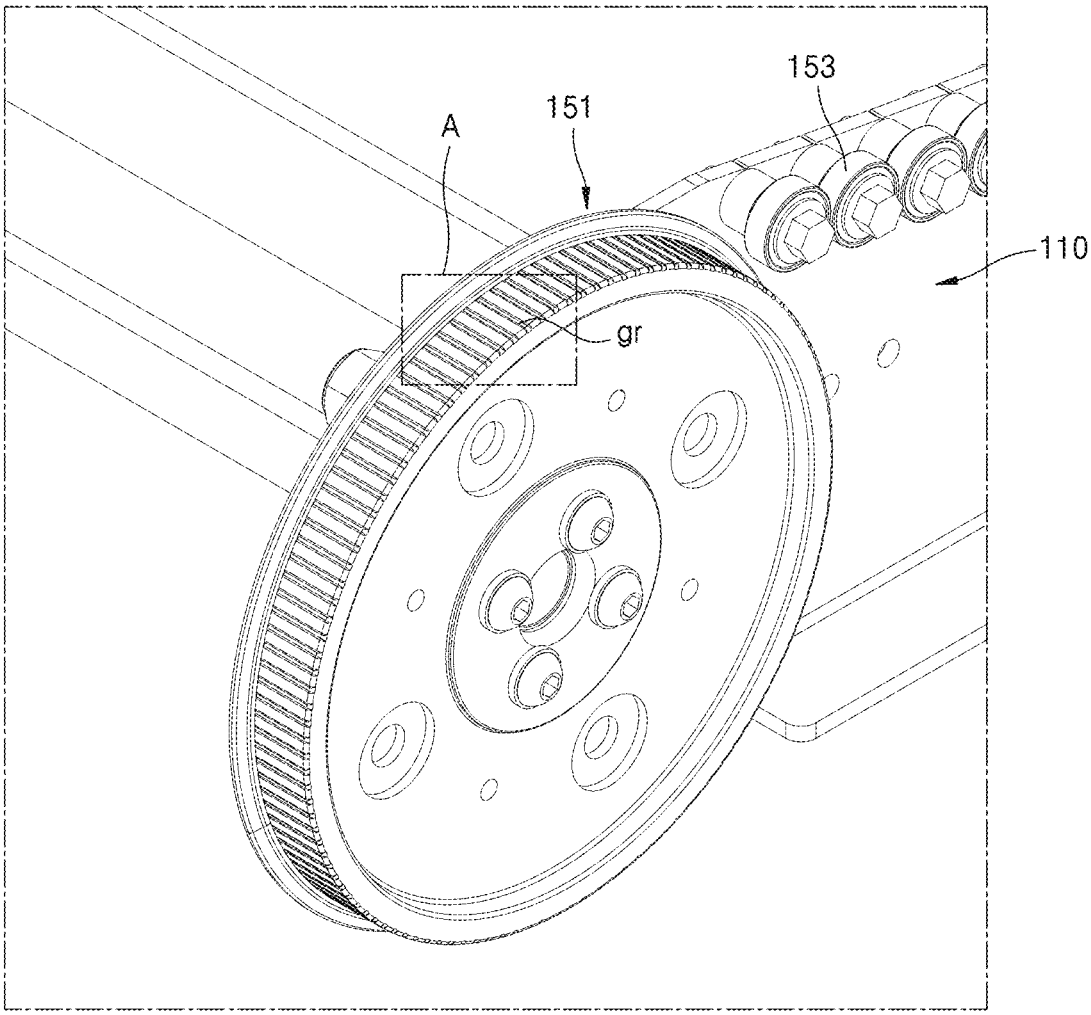
FIG. 7 is a perspective view of the first rotation member in the treadmill of FIG. 3.
Figure 8:
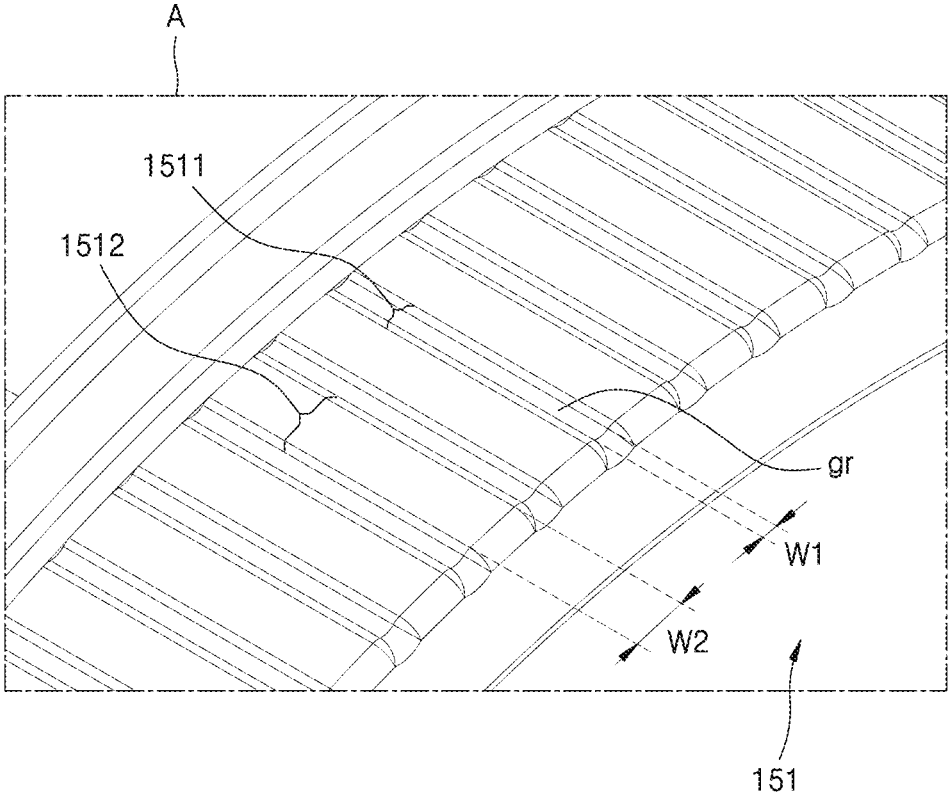
FIG. 8 is an enlarged view of a region A of FIG. 7.
Figure 9:
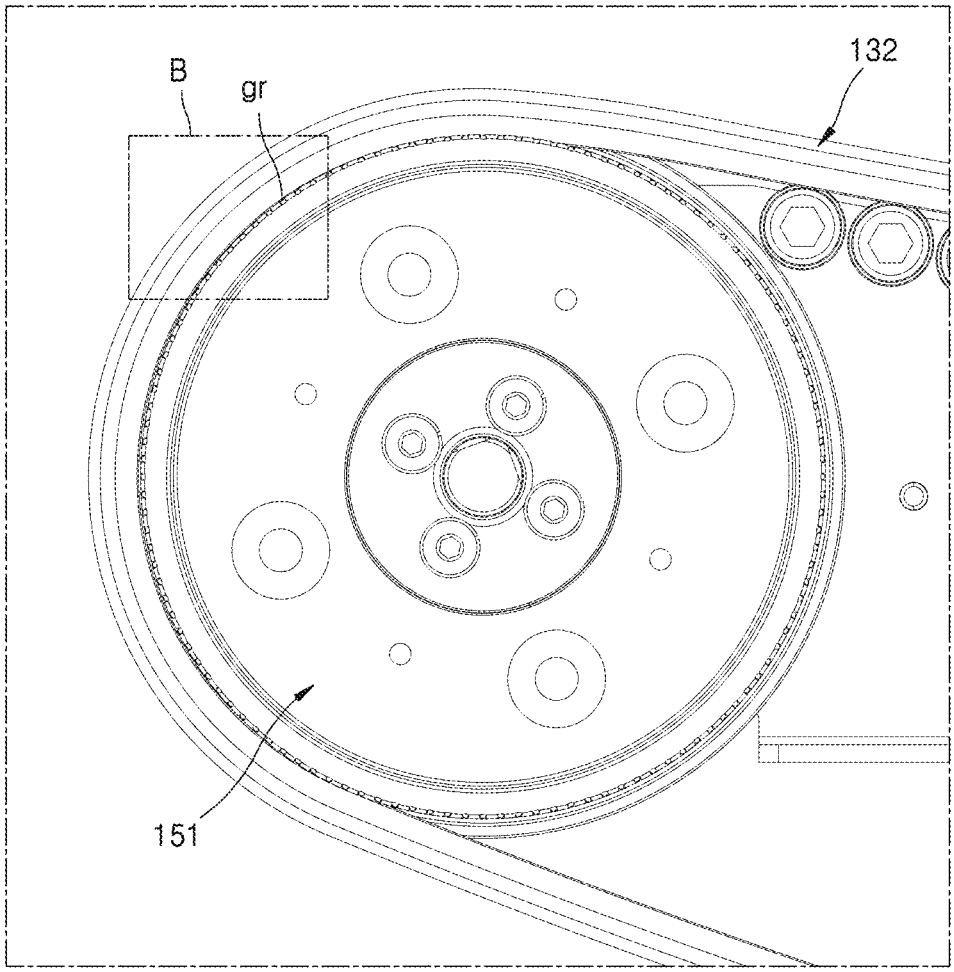
FIG. 9 is a view for explaining the operation of the first rotation member and the track belt of the treadmill according to an embodiment.
Figure 10:
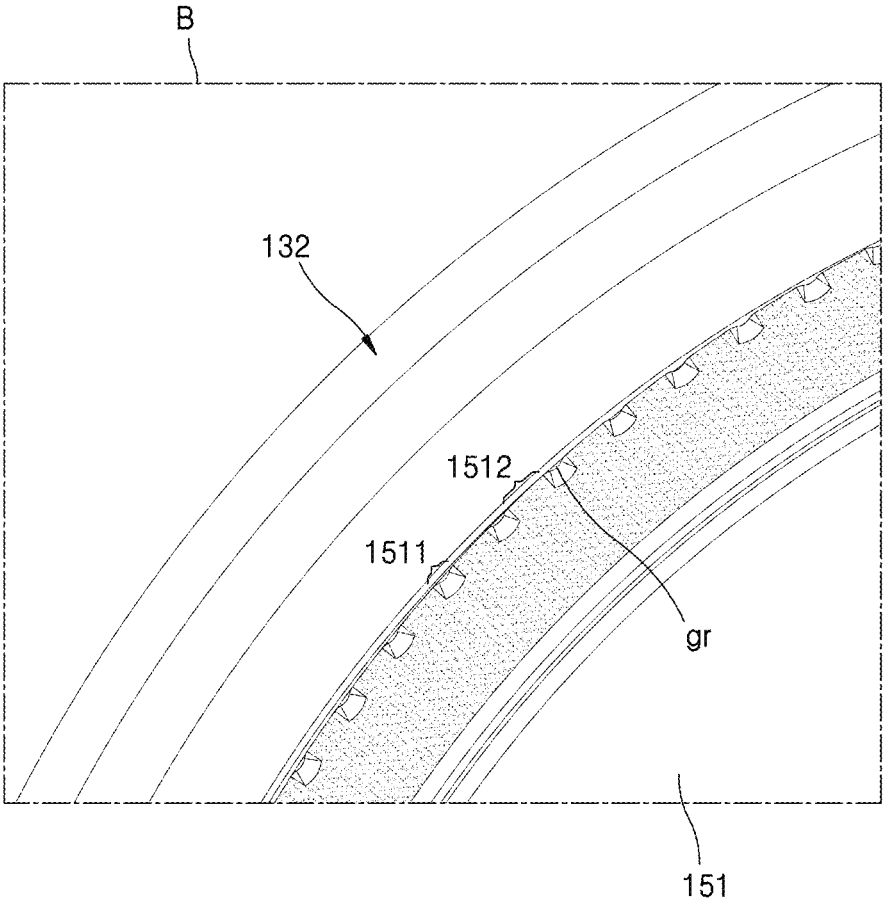
FIG. 10 is an enlarged view of a region B of FIG. 9.

FIG. 7 is a perspective view of the first rotation member 151 in the treadmill 1 of FIG. 3. FIG. 8 is an enlarged view of a region A of FIG. 7. FIG. 9 is a view for explaining the operation of the first rotation member 151 and the track belt 132 of the treadmill 1 according to an embodiment. FIG. 10 is an enlarged view of a region B of FIG. 9.

Referring to FIGS. 7 to 10, a plurality of grooves gr may be arranged apart from each other in a circumferential direction on an outer circumferential surface of the first rotation member 151 such that the first rotation member 151 according to an embodiment has a surface shape different from an inner circumferential surface of the track belt 132.

The grooves gr may be arranged in the circumferential direction at regular intervals. However, the interval of the grooves gr is not limited thereto, and there may be various intervals. For example, the interval of the grooves gr may be random.

The inner circumferential surface of the track belt 132 may have a shape different from the outer circumferential surface of the first rotation member 151. For example, when the grooves gr are formed in the outer circumferential surface of the first rotation member 151, grooves or protrusions may not be formed on the inner circumferential surface of the track belt 132. For example, the inner circumferential surface of the track belt 132 may have an unpatterned shape.

As such, when the grooves gr are formed in the outer circumferential surface of the first rotation member 151, even when slip occurs between the first rotation member 151 and the track belt 132, slip occurs regularly and shortly by the grooves gr so that a noise problem according that irregular slip occurs long may be improved.

The outer circumferential surface of the first rotation member 151 may be divided into a non-contact area 1511 in which the grooves gr are formed and a contact area 1512 in which the grooves gr are not formed. As the contact area 1512 has a structure that protrudes compared with the non-contact area 1511, while the contact area 1512 contacts the track belt 132, the non-contact area 1511 does not contact the track belt 132.

A width W1 of the non-contact area 1511 in the circumferential direction may be less than a width W2 of the contact area 1512 in the circumferential direction. When the width W1 of the non-contact area 1511 is greater than or equal to the width W2 of the contact area 1512, an effect of a reduced contact area between the track belt 132 and the first rotation member 151 occurs greatly, and thus, a side effect according to an effect of a reduced frictional force between the track belt 132 and the first rotation member 151 may occur. In contrast, by reducing the width W1 of the non-contact area 1511 less than the width W2 of the contact area 1512, the side effect of a reduced contact area may be reduced and the noise problem according to the irregular slip may be improved.

A ratio of an area occupied by the non-contact area 1511 to the overall area of the outer circumferential surface of the first rotation member 151 may be 5% or more. A ratio of an area occupied by the non-contact area 1511 to the overall area of the outer circumferential surface of the first rotation member 151 may be less than 50%.

The contact area 1512 may extend in a lengthwise direction perpendicular to the width direction of the first rotation member 151. The shape of the contact area 1512 may be a bar shape having a length greater than a width. However, the shape of the contact area 1512 is not limited thereto, and various shapes such as a rhombic shape, and the like.

Although a structure in which the grooves gr are formed in the first rotation member 151 disposed in the front side is mainly described in the above-described embodiment, this is merely exemplary, and the structure may also be applied to the first rotation member 151 disposed in the rear side. Furthermore, the grooves gr may be formed in the outer circumferential surface of each of four first rotation members 151 disposed in the front and rear sides, but the disclosure is not limited thereto, and the grooves gr may be formed in the outer circumferential surface of some of the first rotation members 151.

Figure 11:
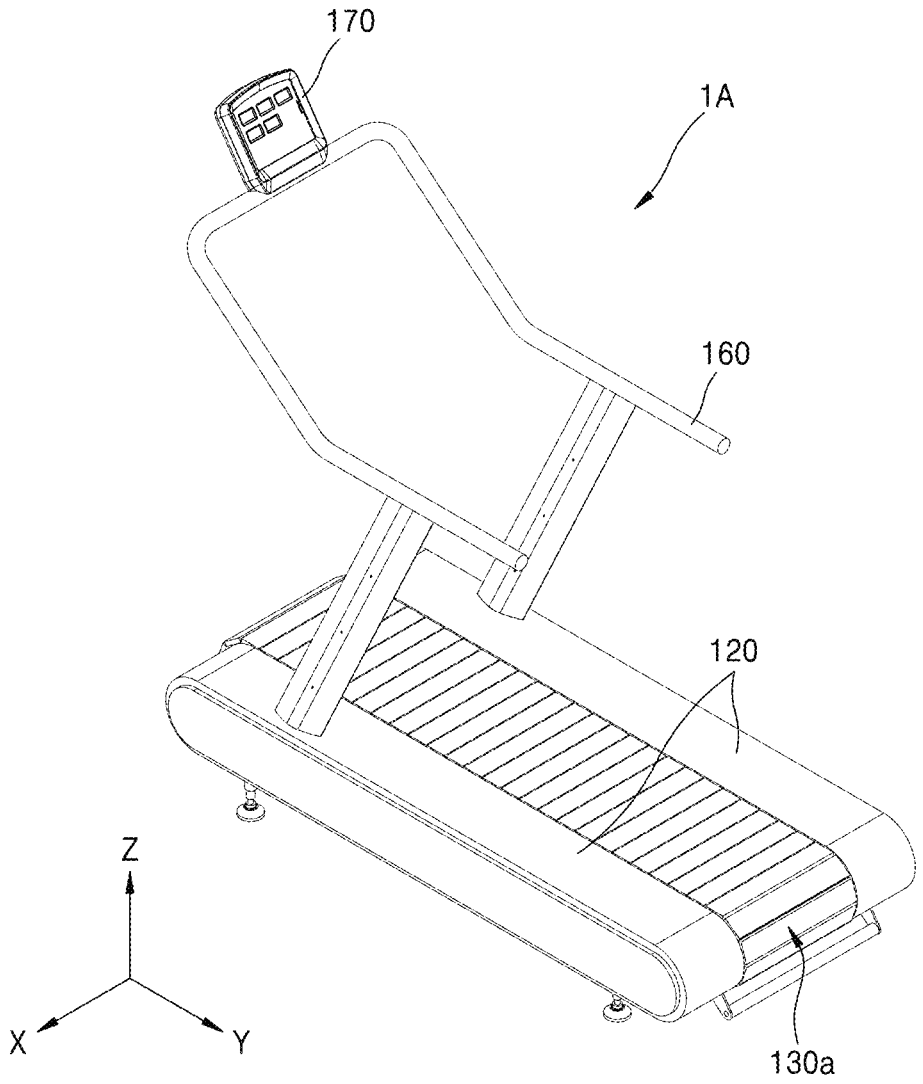
FIG. 11 is a perspective view of a treadmill according to an embodiment.

Although, in the above-described embodiment, the treadmill 1 in which a middle portion of the upper area 1321 of the track part 130 has a concave shape is mainly described, the disclosure is not limited thereto. For example, as illustrated in FIG. 11, the first rotation member 151 according to the above-described embodiment may be applied to a treadmill 1A in which the middle portion of an upper area of a track part 130*a* is not concave, but has a flat shape.

Hereinafter, the disclosure is further described in detail with an embodiment and a comparison example. However, the disclosure is not limited to the embodiment described below.

Figure 12:
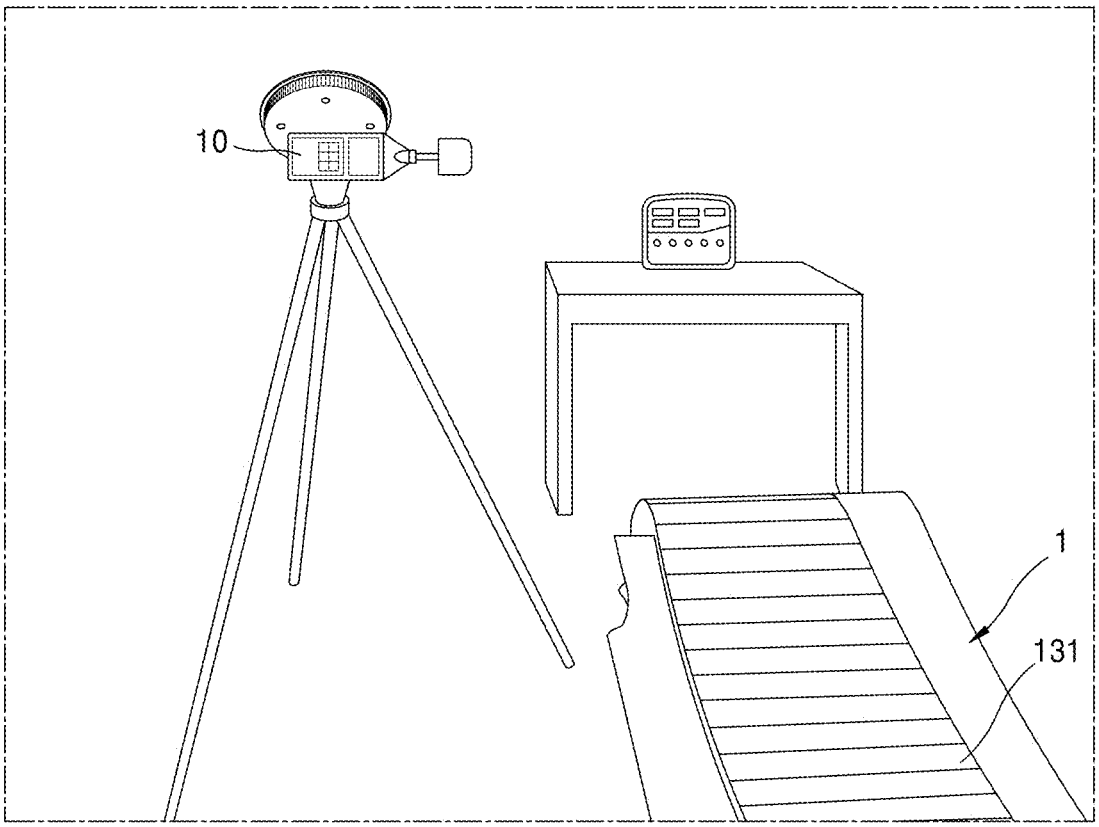
FIG. 12 is an image showing a process of measuring noise of a treadmill before exercise.
Figure 13A:
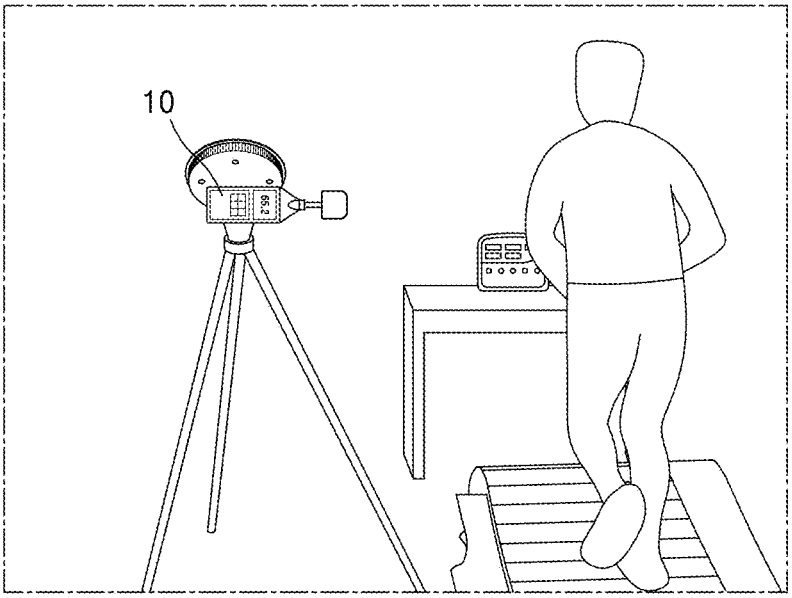
FIG. 13A is an image showing a process of measuring noise of a treadmill according to Embodiment 1 during exercise.
Figure 13B:
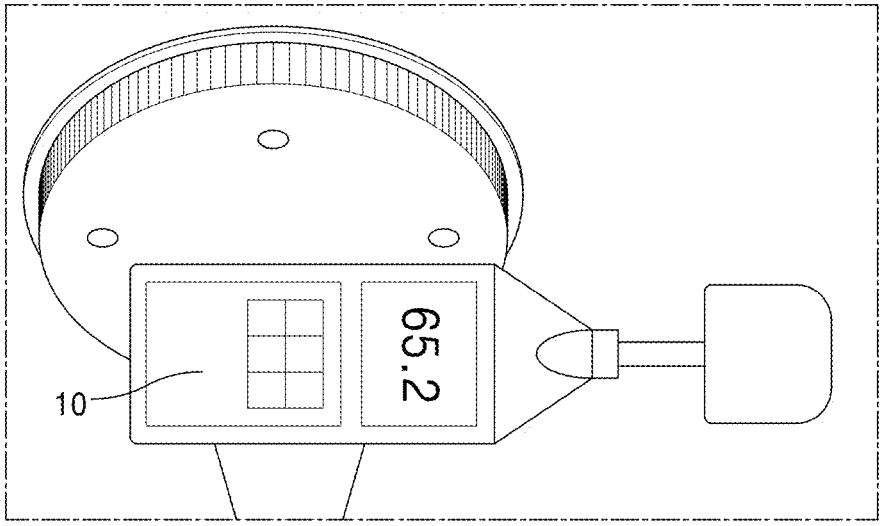
FIG. 13B is an image obtained by partially enlarging a part of FIG. 13A.
Figure 14A:
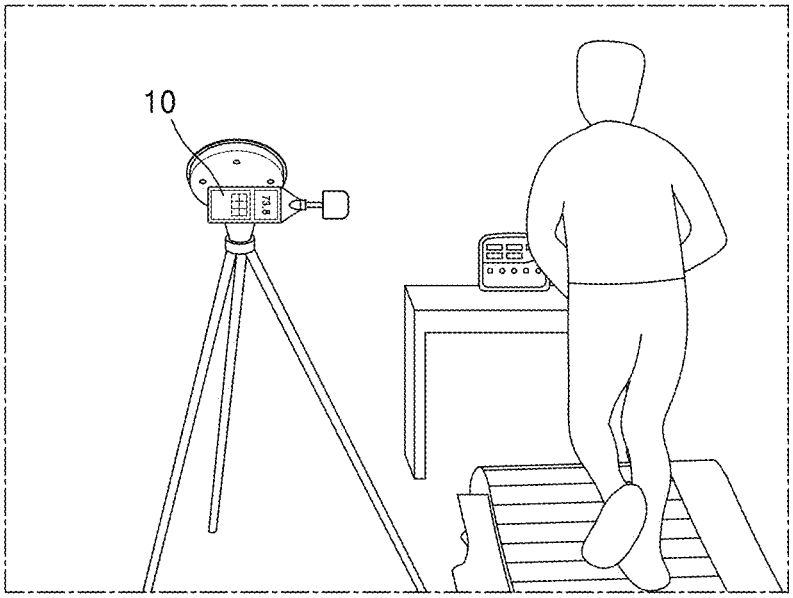
FIG. 14A is an image showing a process of measuring noise of a treadmill according to Comparative Example 1 during exercise.
Figure 14B:
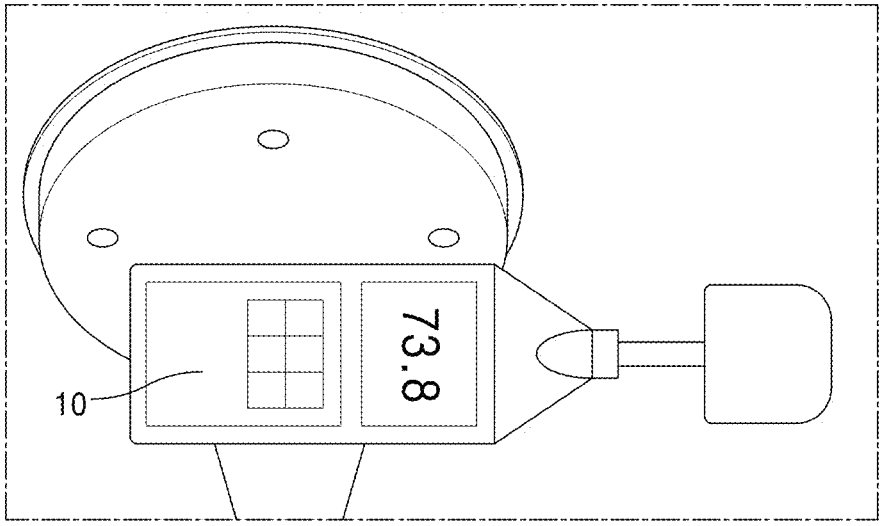
FIG. 14B is an image obtained by partially enlarging a part of FIG. 14A.

FIG. 12 is an image showing a process of measuring noise of the treadmill 1 before exercise. FIG. 13A is an image showing a process of measuring noise of the treadmill 1 according to Embodiment 1 during exercise, and FIG. 13B is an image obtained by partially enlarging a part of FIG. 13A. FIG. 14A is an image showing a process of measuring noise of a treadmill according to Comparative Example 1 during exercise, and FIG. 14B is an image obtained by partially enlarging a part of FIG. 14A.

Embodiment 1

In the treadmill 1 according to an embodiment, grooves are formed in the outer circumferential surface of the first rotation member 151. The treadmill 1 has a track part including the slats 131, and is rotated by a user's foot operation.

Comparative Example 1

In a treadmill according to a comparative example, grooves are not formed in the outer circumferential surface of the first rotation member 151, and the other structures and conditions are the same as those of Embodiment 1. As an example therefor, the treadmill according to the comparative example is in a state in which the first rotation member 151 of the treadmill according to Embodiment 1 is replaced with a first rotation member in which no groove is formed in the outer circumferential surface thereof.

[Experimental Conditions]

In the present experiment, a measuring equipment 10 having basic specifications of 30 dB-130 dB and 20 Hz-8000 Hz was used. The measuring equipment 10, as illustrated in FIG. 12, performed measurements under the installation conditions in which the shortest distance from a first rotation member of a treadmill is 1000 mm, a distance from the bottom surface is 1200 mm, and ambient noise before rotating the treadmill is 40.6 dB.

Referring to FIGS. 13A, 13B, 14A, and 14B, in both treadmills according to Embodiment 1 and Comparative Example 1, Table 1 shows a result of measuring noise when an experimenter runs at the same speed of 14 km/h.

TABLE 1

| | Noise before exercise (dB) | Noise during exercise (dB) | Noise increment (dB) |
|---|---|---|---|
| Comparative Example 1 | 40.6 | 73.8 | 33.2 |
| Embodiment 1 | 40.6 | 65.2 | 24.6 |

As a result of measuring noise generated during exercise in the treadmills according to Comparative Example 1 and Embodiment 1, the treadmill according to Comparative Example 1 generates noise of 73.8 dB, while the treadmill according to Embodiment 1 generates noise of 65.2 dB. Considering that the ambient noise measured before exercise is 40.6 dB, the amount of noise generated during exercise from the treadmill according to Comparative Example 1 is 33.2 dB, while the amount of noise generated during exercise from the treadmill according to Embodiment 1 is merely 24.6 dB. The noise increment (24.6 dB) of the treadmill according to Embodiment 1 is reduced to 75% or less of the noise increment (33.2 dB) of Comparative Example 1. Accordingly, by forming grooves in the outer circumferential surface of the first rotation member, noise generation may be remarkably reduced.

Other aspects, features, and advantages than those described above will become apparent from the following drawings, claims, and detailed description of the disclosure. These general and specific embodiments may be implemented by using a system, a method, a computer program, or a combination thereof.

According to the treadmill and the pulley used in the treadmill according to an embodiment of the disclosure, by improving the shape of the outer circumferential surface of the pulley, collision between the track belt and the pulley may be reduced, and thus, the generation of noise in the treadmill may be reduced.

It should be understood that embodiments described herein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope of the disclosure as defined by the following claims.

What is claimed is:

1. A treadmill comprising:

a frame structure;

a track part configured to rotate with respect to the frame structure; and a rotation unit disposed in the frame structure and configured to rotatably support the track part, wherein the track part comprises:

a plurality of slats arranged in a rotation direction; and a track belt disposed at both end portions of the plurality of slats and connecting the plurality of slats, wherein the rotation unit comprises:

first rotation members disposed in front and rear of the frame structure; and a plurality of second rotation members disposed between the first rotation members, having a diameter less than a diameter of each of the first rotation members, and arranged according to an upper shape of the frame structure, and wherein at least one of the first rotation members includes a plurality of grooves arranged apart from each other on an outer circumferential surface of the at least one of the first rotation members in a circumferential direction, wherein an inner circumferential surface of the track belt comprises no protrusions to be engaged with the plurality of grooves during rotation of the track part.

2. The treadmill of claim 1, wherein the outer circumferential surface of the at least one of the first rotation members comprises a plurality of non-contact areas in which the plurality of grooves are formed and a plurality of contact areas disposed between the plurality of grooves and contacting the track belt.

3. The treadmill of claim 2, wherein a width of each of the plurality of non-contact areas in the circumferential direction is less than a width of each of the plurality of contact areas in the circumferential direction.

4. The treadmill of claim 1, wherein the plurality of grooves are arranged in the circumferential direction at regular intervals.

5. The treadmill of claim 1, wherein the track part is configured to be rotated, without power, by a user.

6. The treadmill of claim 1, wherein an upper shape of the frame structure has a concave shape in a middle portion thereof.

7. The treadmill of claim 1, wherein the inner circumferential surface of the track belt comprises a plurality of surface regions configured to respectively directly face the plurality of grooves during rotation of the track part, and wherein no protrusions to be engaged with the plurality of grooves are formed on any of the plurality of surface regions of the inner circumferential surface of the track belt.

8. A pulley of a treadmill, the pulley rotatably supporting a track belt of a track part in the treadmill, the track part comprising a track belt which comprises an inner circumferential surface including a plurality of surface regions, the pulley comprising:

an outer circumferential surface, a plurality of grooves arranged apart from each other on the outer circumferential surface, the plurality of grooves configured to respectively directly face the plurality of surface regions of the inner circumferential surface of the track belt during rotation of the track part, none of the plurality of grooves configured to be engaged with the plurality of surface regions during rotation of the track part.

9. The pulley of claim 8, wherein the outer circumferential surface comprises:

a plurality of non-contact areas in which the plurality of grooves are formed, and a plurality of contact areas disposed between the plurality of grooves, and wherein the plurality of contact areas are configured to contact the track belt.

10. The pulley of claim 9, wherein a width of each of the plurality of non-contact areas in the circumferential direction is less than a width of each of the plurality of contact areas in the circumferential direction.

11. The pulley of claim 8, wherein the plurality of grooves are arranged in the circumferential direction at regular intervals.

* * * * *